US005568989A

United States Patent [19]

Benguigui

[11] Patent Number: 5,568,989

[45] Date of Patent: Oct. 29, 1996

[54] CASE FOR STORAGE AND APPLICATION OF PASTY PRODUCTS

[76] Inventor: Daniel R. Benguigui, Rue Launay Jacquet La Roncière, Fontenay Les Briis, France, 91640

[21] Appl. No.: 380,870

[22] Filed: Jan. 30, 1995

[30] Foreign Application Priority Data

Feb. 1, 1994 [FR] France ..... 94 01089

[51] Int. Cl.[6] ..... A45D 40/02

[52] U.S. Cl. ..... 401/59; 401/60

[58] Field of Search ..... 401/59, 60

[56] References Cited

U.S. PATENT DOCUMENTS

| | | | |
|---|---|---|---|
| 3,810,700 | 5/1974 | Bryan | 401/59 |
| 4,367,965 | 1/1983 | Speitel et al. | 401/60 |
| 4,723,858 | 2/1988 | Zinnbauer | 401/60 |

FOREIGN PATENT DOCUMENTS

| | | | |
|---|---|---|---|
| 172357 | 9/1952 | Austria | 401/59 |
| 928769 | 12/1947 | France | 401/59 |
| 1491052 | 8/1967 | France | 401/59 |
| 590637 | 8/1977 | Switzerland | 401/59 |

*Primary Examiner*—Steven A. Bratlie
*Attorney, Agent, or Firm*—Pennie & Edmonds

[57] ABSTRACT

A case for a stick of pasty products comprising an elongated hollow casing closed at one end and open at the other, a stick-carrying cup mounted for axial motion within the casing, a cup-moving device comprising a strip of flexible material fastened at one end to the cup and carrying, at the other end, outer strip displacement control means accessible through a longitudinal window in the top wall of the casing, the strip being guided in guide grooves on each side wall of the case and opening outwards at the opening of the casing, for the insertion of the strip into the casing through this opening, after the casing is formed.

8 Claims, 2 Drawing Sheets

1
2
3
4
5
6
15
16
18
22
26
30
33
45
46
47
48
53
P
F

CASE FOR STORAGE AND APPLICATION OF PASTY PRODUCTS

The invention relates to a case for a stick of pasty in particular cosmetic or pharmaceutical products, of the kind comprising a hollow casing of elongated shape opened at one end and closed at the other end, a stick-carrying cup mounted in axially movable relationship in the said casing between a position retracted into the latter and a position of use in which the stick is projecting through the open end, a device for displacing the cup comprising a strip flexible in its longitudinal direction, fastened to one end of the cup and guided at its longitudinal edges in guide grooves extending along two faces of the casing which are located opposite to each other and form at the closed end a curved guide trackway so that the strip may move axially in the casing in the guide grooves, and a means for controlling the displacement of the strip, made fast to the latter and movable in an axial window formed in a wall parallel to the strip and accessible from the outside as well as means for closing the opening of the casing when the cup is in its retracted position, which are formed of the free end of the strip.

The invention also relates to a method of assembling the case according to the invention. Cases for a stick of pasty products of this type are already known. In the case of such cases, the means for operating the displacement of the strip are formed of a button which is slidably mounted onto the corresponding outside face of the casing and is connected to the strip by a connecting portion of small size. The window for the passage of the connecting element is then made in the shape of a slot with a relatively small width. To put the strip in place inside of the casing, the latter consists of two shells which are assembled after the insertion of the strip and fastened to each other for example as by welding.

These known cases exhibit the major inconvenience that the assembly is relatively complex and not easy to be carried out. In particular the insertion of the strip provided with the operating button is an awkward operation difficult to be performed manually and even more problematic if it had to be carried out automatically.

The object of the present invention is therefore to provide a case of the kind stated hereabove which exhibits a structure permitting a quicker and easy mounting as well manually as automatically.

To reach this goal the case according to the invention is characterized in that the guide grooves of each edge of the strip are opening outwards at the aperture of the casing so that the strip may be inserted into the internal guide trackway through this aperture.

The method of assembling the case according to the invention is characterized in that one at first provides the casing as a whole and then inserts the strip through the aperture of the casing.

The invention will be better understood and further objects, characterizing features, details and advantages thereof will appear more clearly as the following explanatory description proceeds with reference to the accompanying diagrammatic drawings given by way of non limiting example only illustrating a presently preferred specific embodiment of the invention and in which.

Figures 1, 2, 3, 9:
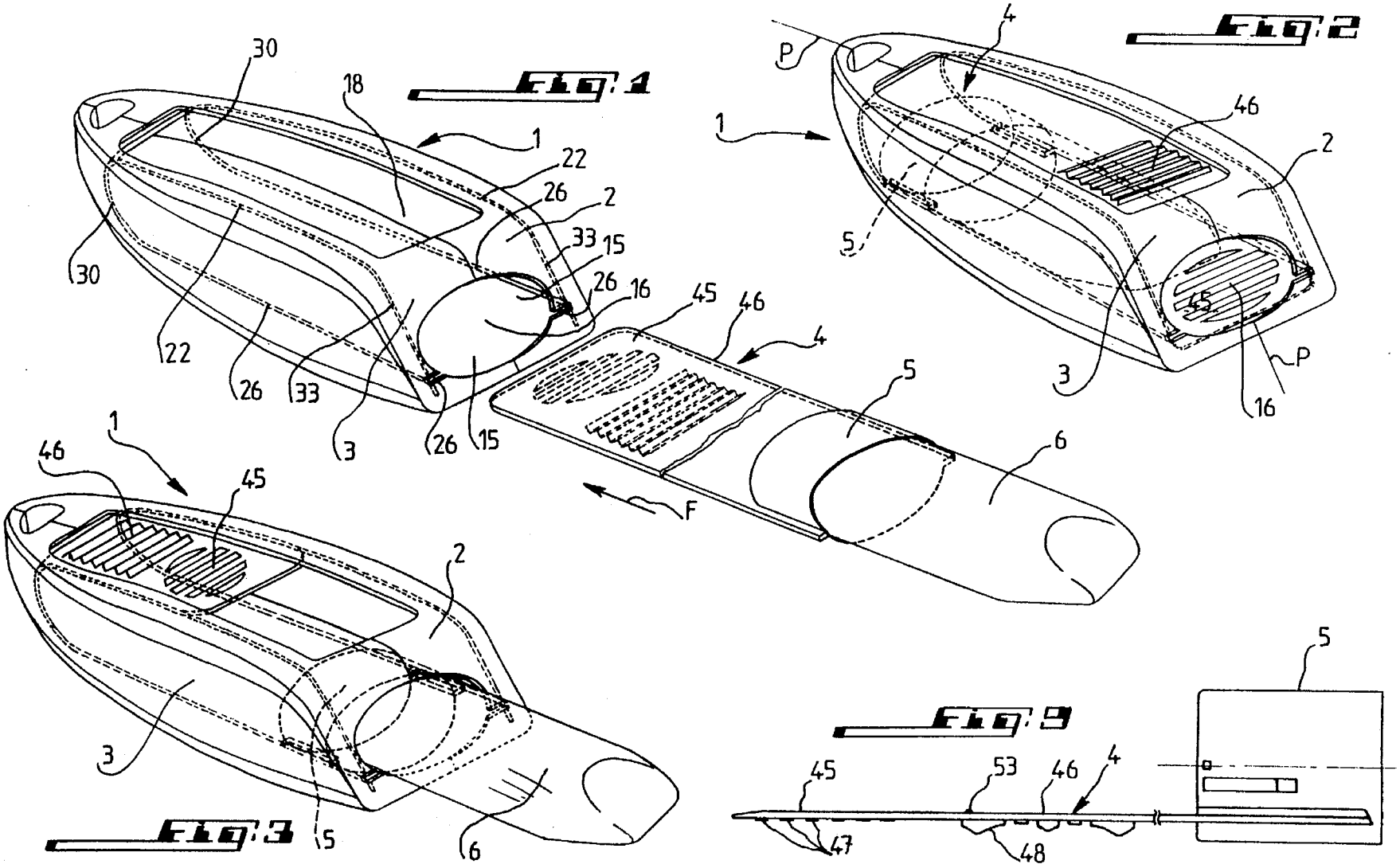
FIG. 1 is a perspective view of the case for a stick of pasty products according to the invention before the insertion of the strip for moving the stick-carrying cup.
FIG. 2 is a perspective view in the assembled condition, the cup assuming its retracted position.
FIG. 3 is a perspective view of the case according to the invention after assembly, the cup assuming its position of use in which the stick has been moved or extended out.
FIG. 9 is a side view of the strip shown on FIG. 1.

Referring to the figures, one sees that the case according to the invention essentially comprises a casing 1 consisting of two parts 2, 3 each one in the shape of a shell and a strip, ribbon or tape 4 which in the state inserted into the casing 1 forms the means for displacing a cup or socket 5 adapted to receive a stick of a pasty cosmetic, pharmaceutical or like product. This stick is designated at 6. As shown on FIGS. 1 to 3, both shell-shaped parts 2 and 3 of the case 1 exhibit a structure which is symmetrical with respect to the middle plane P. The strip 4 is made from a material flexible in its axial direction at right angles to its width.

Referring to FIGS. 4 to 8, one will hereinafter describe with more details the structure of both shells 2 and 3 of the case which are identical except for the means for assembling the shells which are complementary or mating and of the stud-and-receiving hollow type.

It appears from the figures that each shell 2 and 3 generally comprises a bottom wall 8, a side wall 9 and a top wall 10. The three walls extend substantially at right angles to each other and form a U-shaped profile to define in the state assembled to the other shell the inner space 11 within which the cup or socket 5 carrying the stick 6 is axially displaceable. One end carrying the reference numeral 13 of each shell is closed whereas the other end designated at 14 is bored through and defines an aperture is in the shape of a half ellipse. Therefore in the assembled condition, the case is closed at one end and defines an aperture 16 in the shape of an ellipse allowing the stick 6 to move out.

In the top wall 10 is formed a cut-out 17 with a predetermined width and opened towards the plane of opening P of the U-shaped formation. The cut-out exhibits a substantially rectangular shape. In the assembled state, the cut-outs 17 of both shells form a window 18 of rectangular shape in the top wall of the case, which extends in the longitudinal direction of the latter over the greatest portion of the length thereof and exhibits a width occupying substantially one half of the width of one case shell.

Figures 4, 5, 6, 7, 8:
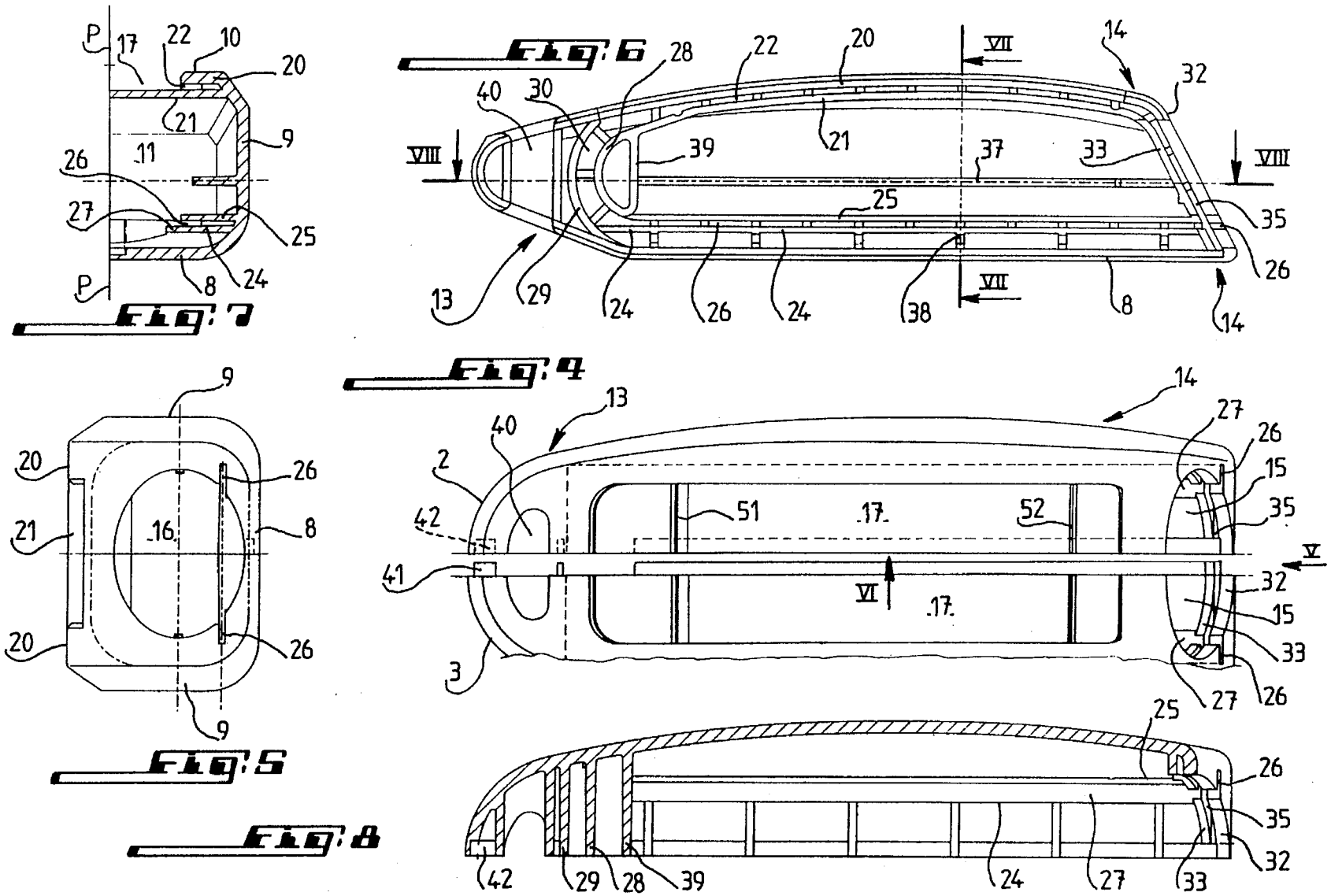
FIG. 4 is a top view of the case according to FIG. 1 with both shells forming the case being separated from each other.
FIG. 5 is a view seen in the direction of the arrow v of FIG. 4 with both shells being in the assembled state.
FIG. 6 is a view seen in the direction of the arrow VI of FIG. 4.
FIG. 7 is a view in cross-section taken upon the line VII—VII of FIG. 6.
FIG. 8 is a view in longitudinal section taken upon the line VIII—VIII of FIG. 6.

As clearly seen in particular on FIG. 7, each shell comprises underneath the cut-out 17 at a predetermined distance from the remaining portion of the top wall 10 designated at 20, a wall 21 which extends from the side wall 9 in parallel relation to the wall portion 20 up to the plane P of opening of the shell. The walls 20 and 21 therebetween define a groove 22 for guiding one longitudinal edge of the strip 4 as this will be explained later.

At some distance from the bottom wall 8, each shell comprises two walls 24, 25 which are parallel to one another and to the wall 8. Both walls 24 and 25 extend from the side wall 9, the lower wall 24 substantially to the middle of the wall 8, the wall 25 being shorter. Both walls therebetween define a groove 26 which also forms a groove for guiding the corresponding side edge of the strip 4. The top surface 27 of the wall 24, which is free, forms a strip-supporting surface. The guide groove 26 opens outwards in the end 14 of the shell and is open towards the opening bore or aperture 15.

Referring to FIG. 5, it is seen that the guide groove 26 is relatively near the bottom wall 8 but extends in the end wall 14 to a depth in the direction of the width which is greater than the width in this direction of that of aperture is.

As it clearly appears from FIG. 6 at the level of the closed end 13 of each case shell, the upper wall 21 is extended by a curved wall 28 with the same width as the wall 21 which meets the narrower lower wall 26. Another curved wall 29 substantially parallel to the wall 28 and with the same height as the latter extends from the upper transverse edge of the cut-out 17 to the lower guide wall 24. Thus the walls 28 and 29 therebetween define a slot with a curved profile 30 which communicates at its ends with the guide grooves 22 and 26, respectively. As seen one thus obtains at the end 13 a guide groove without any discontinuity.

Reverting to the end 14 of the case shells one sees that the end wall designated at 32 in which is formed the aperture 15 extends obliquely with respect to the bottom wall 8 while forming therewith an angle of about 60° in the example shown. In parallel relation to this wall 32 which forms the outside wall extends inside a parallel wall 33 in extension of the wall 21 down to the bottom wall 8. The aperture 15 also extends through this wall 33. The walls 32 and 33 are spaced from each other so as to form about the aperture 15 a groove 35 the width of which is so chosen that it may form a groove for guiding the corresponding longitudinal edge of the strip 4. This groove 35 communicates with one end of the upper guide groove 22 and extends at the other end down to the bottom wall 8 while obliquely intersecting or crossing the guide groove 26.

Both shells 2 and 3 are advantageously made through molding from a plastics material thereby explaining the provisions of some ribs such as those shown at 37 and 38 and of some reinforcing walls such as the wall 39 arranged at the level of the curved inner wall 28 and defining at the level of the end 13 the internal space 11. One further sees on the figures that the end 13 is shaped so as to form a suspension or support eye 40.

For the purpose of completing the description of both shells 2 and 3 one sees on FIG. 1 that they are provided with elements of complementary or mating shapes permitting their assembling through engagement with each other. Thus the shell 3 comprises projecting elements 41 engaging hollow portions 42 provided at the opening plane P of the other shell 2.

Referring in particular to FIGS. 1 and 2 one will hereinafter describe the strip 4 with more details. One sees that the cup or socket 5 carrying the stick 6 which exhibits in the example shown an elliptic shape is fastened onto one end of the strip. Upon the other end portion of the latter are defined two axially aligned areas which carry the reference numerals 45 and 46. The zone 45 which forms the means for closing the opening 16 of the case as shown on FIG. 2 carries on its bottom side roughness elements 47 on an area of elliptic shape whereas the zone 46 carries on the bottom face protruding elements 48 which extend at right angles to the longitudinal direction of the strip and provide thus for the applying of a thrust force without any risk of slipping of the fingers of a user of the case. FIG. 9 indeed shows that the profile of the projections 48 is adapted to the fingers of the user, the projections being higher at the ends of the gripping zone 46 up to its center.

The structure of the shells 2 and 3 of the case and the configuration of the strip 4 which have just been described permit an easy assembling of these case components. In a first time indeed one assembles both shells 2 and 3 by fitting the assembling studs 41 into complementary or mating hollows or recesses 42. Then both shells are secured to each other as by ultrasound welding. Subsequent to the building up of the casing from both shells 2 and 3, one inserts the strip 4 into the casing with the elements 47, 48 directed downwards or towards the bottom, through the opening 16 and the guide grooves 26 as appearing from FIG. 1. Since the strip is made from a flexible material but with some stiffness, the strip may be inserted by pushing it in the direction of the arrow F. Owing to the fact that the guide grooves of each shell, which are designated in broken lines or dashes on FIGS. 1 and 3 form a guide trackway without any discontinuity, the flexibility of the strip would permit it to follow the curvatures or bends of the guide trackway. It is further to be pointed out that the aperture 16 of the casing is slightly greater than the dimensions of the cup 5 to allow the passage of the latter during the insertion of the strip. As shown on FIGS. 2 and 3 on which the cup assumes its inward retracted and outward extended end positions, respectively, the length of the strip 4 is selected in such a manner that in each one of the positions, the gripping zone 46 is lying at the level of one of the ends of the window 18 of the casing. In the retracted end position of the cup, the zone 45 is located in the forward-or front end (FIG. 2) whereas in the position of use the zone 45 is located at the level of the other end. When the strip is in its retracted position, the forward or leading zone 45 of the strip shuts off the aperture 16 with the front edge of the strip moving downwards in the forward guide groove 35 (FIG. 6) down to the bottom wall 8 while even crossing or intersecting the grooves 26. It should further be noted that the width of the gripping zone 45° is slightly greater than the width of the window 18.

To fasten the strip in each one of both positions, one has formed in the upper face of the upper guide wall in the zone of each end of the window 18 or of the cut-out 17 in the upper wall 21 of each shell a transverse groove 51, 52 which is engaged by a rib 53 provided on the top face of the strip.

Various modifications may of course be brought to the case structure and to the process which have just been described with reference to the figures. For example the means for operating the displacement of the strip could be provided as an element affixed onto the strip after its insertion in the casing in any suitable known manner. In such a case the width of the longitudinal window could be smaller.

What is claimed is:

1. A case for a stick of a pasty product, said case comprising a hollow casing having an elongated shape closed at a first end and having an aperture at a second, open end and having a bottom wall, a top wall and two side walls, a longitudinal window being provided in said top wall, a stick-carrying cup mounted for axial motion within said casing between a first position retracted into the casing and a second position extended from the casing wherein, in said second position, the stick projects through the aperture in the casing, means for displacing the cup between the first and second positions, said means comprising a strip having first and second ends, said strip formed from a flexible material fastened at said first end to one end of the cup, guided by its longitudinal edges in guide grooves extending on each side wall and carrying at a zone near the second, free end, outer control means for manually displacing the strip, said control means being provided on a surface of the strip so as to be accessible through said window in the top wall of the casing, the length of said window corresponding at least to the length of travel of the cup between the first position and the second position, each strip guide groove provided on each said side wall comprising lower and upper portions extending adjacent the bottom wall and the top wall respectively and a curved portion at said closed end of said casing, the lower strip guide groove portion adjacent said casing bottom wall being open to the exterior at a location slightly above said casing bottom wall and communicating with said opening of said casing, said strip being secured to said stick-carrying cup at a location adjacent to said casing bottom wall, said outer control means for displacing said strip being formed by means which project from said strip surface a distance less than the distance between said lower strip guide portion and said bottom wall, said strip being made from a flexible material having a stiffness in its longitudinal direction which is sufficient to allow the insertion through said opening by a pushing force exerted upon the strip in the insertion direction after the manufacture of said casing.

2. The case of claim 1, wherein the free end of the strip is shaped to constitute means for closing the opening of the casing when the cup is retracted to said first position.

3. The case of claim 2, wherein said second, open end of said casing comprises an end wall which defines an opening configured and adapted to permit passage of said stick, wherein said end wall is substantially rectilinear but inclined with respect to the bottom wall at an angle smaller than 90° and wherein each said side wall of said casing comprises a strip guide groove portion extending along an edge thereof adjacent said end wall down to said bottom wall for guiding said free end of said strip for closing said opening of said casing, said angle being dimensioned to facilitate the displacement of a closing end zone of the strip behind said opening.

4. The case of claim 1, wherein said case has a substantially rectangular cross-section.

5. The case of claim 1, wherein said case is formed by two casing shells provided with assembly means for assembling these shells to one another without said strip having said stick carrying cup secured thereto being disposed within said case.

6. The case of claim 1, wherein said outer control means for displacing said strip comprises a plurality of projecting elements on a face of the strip which is visible through said window at a level of the end of the strip not connected to said stick-carrying cup, said window exhibiting a sufficient width to allow one finger of the user of the case to grip said projecting elements.

7. The case of claim 1, wherein the casing comprises, underneath the window, an additional wall extending in parallel relation to the top wall for defining together with the top wall the upper guide groove portion for the strip, the top face of this additional wall forming a bearing face for the strip.

8. A method for assembling a case for a stick of a pasty product comprising a hollow casing having an elongated shape closed at a first end and having an aperture at a second open end and having a bottom wall, a top wall and two side walls, a longitudinal window being provided in said top wall, a stick-carrying cup mounted for axial motion within said casing between a first position retracted into the casing and a second position extended from the casing, wherein, in said second position, the stick projects through the aperture in the casing, means for displacing the cup between the first and second positions, said means comprising a strip having first and second ends, said strip formed from a flexible material fastened at said first end to one end of the cup, guided by its longitudinal edges in guide grooves extending on each side wall and carrying at a zone near the second, free end, outer control means for manually displacing the strip, said control means being provided on a surface of the strip so as to be accessible through said longitudinal window in the top wall of the casing, the length of said window corresponding at least to the length of travel of the cup between the first position and the second position, each strip guide groove provided on each said side wall comprising lower and upper portions extending adjacent the bottom wall and the top wall respectively and a curved portion at said closed end of said casing, the lower strip guide groove portion adjacent said casing bottom wall being opened to the exterior at a location slightly above said casing bottom wall and communicating with said opening of said casing, said strip being secured to said stick-carrying cup at a location adjacent to said casing bottom wall, said outer control means for displacing said strip being formed by means which project from said strip surface a distance less than the distance between said lower strip guide portion and said bottom wall, said strip being made from a flexible material having a stiffness in its longitudinal direction which is sufficient to allow the insertion through said opening by a pushing force exerted upon the strip in the insertion direction, the method comprising the steps of assembling said casing and then inserting said strip into said casing through said aperture and into the strip guide groove by its free end.

* * * * *